US009355516B2

(12) United States Patent
Stoffel et al.

(10) Patent No.: US 9,355,516 B2
(45) Date of Patent: May 31, 2016

(54) DISPENSING CABINET AND METHOD FOR THE CONTROLLED DISPENSING OF OBJECTS

(75) Inventors: Kai Konstantin Stoffel, Innsbruck (AT); Armin Isser, Innsbruck (AT)

(73) Assignee: Kai Konstantin Stoffel, Innsbruk (AT)

( * ) Notice: Subject to any disclaimer, the term of this patent is extended or adjusted under 35 U.S.C. 154(b) by 19 days.

(21) Appl. No.: 14/343,821

(22) PCT Filed: Aug. 28, 2012

(86) PCT No.: PCT/EP2012/003614

§ 371 (c)(1), (2), (4) Date: Mar. 7, 2014

(87) PCT Pub. No.: WO2013/034256

PCT Pub. Date: Mar. 14, 2013

(65) Prior Publication Data

US 2014/0229003 A1 Aug. 14, 2014

(30) Foreign Application Priority Data

Sep. 9, 2011 (EP) ..... 11007353

(51) Int. Cl.
*G07F 11/54* (2006.01)
*G07F 11/00* (2006.01)
(Continued)

(52) U.S. Cl.
CPC *G07F 11/00* (2013.01); *B25H 3/00* (2013.01); *G07F 11/48* (2013.01); *G07F 11/54* (2013.01); *G07F 11/56* (2013.01); *G07F 17/12* (2013.01)

(58) Field of Classification Search
CPC ..... G07F 11/54; G07F 11/002
USPC ..... 221/119
See application file for complete search history.

(56) References Cited

U.S. PATENT DOCUMENTS 3,979,017 A * 9/1976 O'Toole et al. ..... 221/7
4,049,154 A * 9/1977 Burks ..... 221/76
(Continued)

FOREIGN PATENT DOCUMENTS

DE 29803081 U1 5/1998
DE 102007027012 A1 1/2008
(Continued)

OTHER PUBLICATIONS

International Preliminary Report on Patentability and translation of Written Opinion of the International Searching Authority corresponds to PCT/EP2012/003614 issued on Mar. 12, 2014.
(Continued)

*Primary Examiner* — Timothy Waggoner
(74) *Attorney, Agent, or Firm* — Studebaker & Brackett PC

(57) ABSTRACT

The invention relates to a dispensing cabinet and a method for the controlled dispensing of objects. The dispensing cabinet comprises a housing, a storage unit which is arranged in the housing and has a plurality of storage spaces for the objects and an input member for selecting an object to be dispensed and for inputting object- and/or user-related data. On the housing a dispensing opening is provided, on which several lockable access doors are arranged. A drive member moves a storage unit inside the housing, wherein a storage space containing the selected object can be positioned at the dispensing opening. Furthermore, a control unit is provided, with which the drive member can be controlled in order to position the selected object in front of the dispensing opening and the access door in front of the storage space containing the desired object can be unlocked to give access to a user.

6 Claims, 2 Drawing Sheets

(51) Int. Cl.

| | |
|---|---|
| ***B25H 3/00*** | (2006.01) |
| ***G07F 17/12*** | (2006.01) |
| ***G07F 11/48*** | (2006.01) |
| ***G07F 11/56*** | (2006.01) |

(56) References Cited

U.S. PATENT DOCUMENTS

| | | | | |
|---|---|---|---|---|
| 5,068,643 | A * | 11/1991 | Yashina | 340/571 |
| 5,169,027 | A * | 12/1992 | Falk et al. | 221/2 |
| 5,172,829 | A | 12/1992 | Dellicker, Jr. | |
| 5,205,436 | A | 4/1993 | Savage | |
| 5,337,920 | A * | 8/1994 | Clausen | 700/243 |
| 6,587,748 | B2 * | 7/2003 | Baack | 700/237 |
| 7,086,558 | B1 * | 8/2006 | Pixley et al. | 221/7 |
| 8,442,676 | B2 * | 5/2013 | Kobayashi et al. | 700/242 |
| 2004/0104652 | A1 | 6/2004 | Holmes et al. | |
| 2008/0309583 | A1 | 12/2008 | Hsieh | |
| 2010/0017023 | A1 | 1/2010 | Jacomet et al. | |

FOREIGN PATENT DOCUMENTS

| | | | |
|---|---|---|---|
| DE | 202009016806 | U1 | 8/2010 |
| DE | 102009049308 | B3 | 6/2011 |
| EP | 0710936 | A1 | 5/1996 |
| EP | 1264666 | A1 | 12/2002 |
| EP | 2113890 | A2 | 11/2009 |
| EP | 2312099 | A2 | 4/2011 |
| GB | 2453977 | A | 4/2009 |
| WO | 02/17249 | A2 | 2/2002 |
| WO | 2004/014189 | A1 | 2/2004 |

OTHER PUBLICATIONS

International Search Report; PCT/ep2012/003614; Nov. 16, 2012.

* cited by examiner

DISPENSING CABINET AND METHOD FOR THE CONTROLLED DISPENSING OF OBJECTS

BACKGROUND OF THE INVENTION

1. Field of the Invention

The invention relates to a dispensing cabinet for a controlled dispensing of objects, in particular tools, having a housing, a storage unit which is arranged in the housing and has a plurality of storage spaces for the objects and an input means for selecting an object to be dispensed and for inputting object- and/or user-related data, in accordance with the preamble of claim 1.

Furthermore, the invention relates to a method for the controlled dispensing of objects, in which the objects are stored in storage spaces of a storage unit which is supported in a housing with a dispensing opening, and by means of an input means an object is selected by a user and object- and/or user-related data are input.

2. Description of Related Art

From DE 10 2009 049 308 B3 or DE 10 2007 027 012 A1 drawer cabinets are known, in which tools or other small parts can be stored in particular. By inputting object-related or personal data via an input terminal a user can gain access to a drawer, in which the desired object is stored. To enable the dispensing of a single part from the drawer the two mentioned documents provide the teaching that the drawer is provided with a plurality of unlockable flaps.

However, these flaps render the drawers relatively large and heavy. Moreover, if heavy metal objects are stored in such a dispensing cabinet this leads to an increased risk of tilting when the drawers are pulled out. In addition, for the storage of a plurality of small parts, as for example several hundred parts, a correspondingly large number of flaps and locking means has to be provided.

From DE 20 2009 016 806 U1 a dispensing cabinet is known, from which a ring-shaped carousel located in an extensible drawer for receiving tools or small parts can be taken. In this known dispensing cabinet there is also the problem of the "risk of tilting" when a drawer is pulled out. In addition, the arrangement of a plurality of drawers with supported carousels requires the provision of a plurality of drive means for the carousel in each drawer.

From DE 298 03 081 U1 a controllable storage and dispensing device can be taken, in which an actuatable and rotatable spiral for receiving at least one object is arranged in each compartment. Through a rotating movement of the spiral the object is conveyed to an ejection chute. However, by ejecting the object through an ejection chute it could get damaged. Moreover, this storage device also requires a plurality of drive means for driving the spiral to be provided in each compartment.

SUMMARY OF THE INVENTION

The invention is based on the object to provide a dispensing cabinet and a method for the controlled dispensing of objects which, whilst having a simple and compact construction, enable a reliable individual dispensing of objects.

The object is achieved on the one hand by a dispensing cabinet having the features of claim 1. On the other hand the object is achieved by a method having the features of claim 12. Preferred embodiments of the invention are stated in the dependent claims.

The dispensing cabinet according to the invention is characterized in that on the housing a dispensing opening is provided, on which several lockable access doors are arranged, in that a drive means is arranged for moving the storage unit inside the housing, wherein a storage space containing the selected object can be positioned at the dispensing opening, and in that a control unit is provided, with which the drive means can be controlled in order to position the selected object in front of the dispensing opening and the access door in front of the storage space containing the desired object can be unlocked in order to give access to a user.

A first aspect of the invention resides in the fact that a movable storage unit with a plurality of storage spaces for the objects to be stored is provided in a housing. Hence, the storage unit always remains inside the housing. The storage unit can be moved by a single or central drive means so that a storage space containing the selected object is transported to a dispensing opening on the housing.

According to a further aspect of the invention a plurality of access doors is arranged at the dispensing opening. In line with the selected object the control unit effects a specific unlocking of the access door which is arranged in front of the storage space containing the selected object at the dispensing opening. Since the unlocking of the access door can be realized with relatively simple switching elements, an altogether simple and compact dispensing device is thus created. Moreover, it is not necessary for a part, in particular a drawer, to be moved out of a housing so that the dispensing cabinet according to the invention is very stable and tilt-resistant.

A particularly preferred embodiment of the invention resides in the fact that the storage unit is designed as a carousel which is supported and driven in a rotatable manner. A rotatable carousel can be driven and actuated in an efficient and simple manner by a rotary drive.

Basically, the carousel-like storage unit can have a horizontal axis of rotation. According to the invention it is especially stable and useful for the carousel to have several storage levels arranged on top of each other. Such a carousel has a vertical or substantially vertical axis of rotation. The storage levels are designed as circular disks or ring elements, along the circumference of which a plurality of storage spaces is arranged. The storage spaces can be separated from each other by simple partition walls.

An advantageous embodiment of the invention furthermore resides in the fact that at the dispensing opening several access doors are arranged on top of each other, wherein one access door is in each case assigned to one storage level of the carousel. Hence, according to the selection of the desired object the storage space stored is determined by the control unit and transported to the vertical dispensing opening. Along the vertical dispensing opening a plurality of access doors is arranged on top of each other. According to the storage level, on which the storage space of the selected object is arranged, the corresponding access door to this storage level is unlocked. A user is thereby granted direct access to the storage space containing the object. Hence, a reliable individual withdrawal of objects is rendered possible.

Basically, the access door can be designed in various ways. For instance a one-part or multi-part sliding door is possible. According to the invention it is particularly preferred that the access door is supported in a pivotable and spring-loaded manner, wherein the access door swings open on being unlocked. The unlocking can be effected, for example, by way of a switching element with an electromagnet. The latter releases a latch, enabling the access door to swing open whilst being under spring-pretension. By preference, the access door is closed again by the user. The correct closure can be checked by an appropriate switching mechanism, and if the access door continues to be open a further operation of the storage unit can be prevented.

An especially robust embodiment of the invention is achieved in that the carousel has a disk-shaped base plate, on which a support structure is arranged, on which the individual storage levels are fixed. In the simplest case, the support structure can comprise a central shaft or several, preferably four support columns, on which the plate- or disk-shaped storage levels are releasably fixed. The storage levels can be inserted laterally or from the top.

According to another embodiment of the invention provision is made in an advantageous manner for the storage levels to be of modular design. For example individual storage modules can be disk or ring segments having a predetermined number of storage spaces. A storage level can have e.g. four disk segments with a 90°-division or eight disk segments with a segment angle of 45°. Such a disk segment can have merely one storage space or several storage spaces, especially three to twelve storage spaces. Depending on the size of the objects to be stored an appropriate storage module with a correspondingly adapted storage space size and number of storage spaces can be selected. The storage level itself can have a support structure that receives the storage modules in an exchangeable manner as simple and light-weight plastic parts.

Another preferred embodiment of the invention resides in the fact that on the base plate a toothing is arranged, through which the carousel is driven by a motor. The toothing can in particular be designed as a toothed rim on the base plate. More particularly, the toothing can be cut directly into the outer circumference of the base plate. By way of a suitable pinion of a motor, especially an electric motor, the base plate is thus driven in a rotating manner by the toothing, whilst interposing, where appropriate, a gear stage.

Depending on the design of the storage levels it is of advantage in accordance with the invention that a size of the dispensing opening is adjustable. The lateral areas of the dispensing opening can be adapted by slidable and fixable sheet plates to the size of the storage spaces employed in each case. Within the meaning of the invention a dispensing opening is not only understood as a single continuous opening. Rather, the dispensing opening can be subdivided by bridges.

An especially user-friendly embodiment of the invention resides in the fact that the control unit has a data memory as well as a computer. The control unit is preferably integrated in the housing of the dispensing cabinet. By preference, the control unit has a touch panel, which permits the direct input of data by the user. However, a data input is also possible by way of a keypad, a chip or card reader, a separate terminal and/or a computer arranged at a distance.

Stored in the data memory of the control unit is information as to which object is stored in which storage space. Furthermore, by way of the control unit it is possible to determine in which position the movable storage unit is located. On the basis of the data and the selection of the user the control unit is initially able to verify an authorization of the user. In addition, for the dispensing of an object further data concerning the intended use, such as an order number, a machine number, a cost center etc. can be queried. In addition to actuating the drive unit the control unit can also provide further information for the user on a suitable display screen, for example relating to costs of the object dispensed or concerning the operating conditions, such as the cutting speed of tools. By way of the computer located within the control unit a complete inventory management can be implemented. An automatic reordering of objects can be carried out in the case of a shortfall of a storage minimum number. In the data memory a status of the user can also be stored, in which case the control unit verifies if an authorization of the user for the dispensing of the object is present.

According to an embodiment of the invention it is especially advantageous for a remote data transmission means to be provided. Through this, current data on usage as well as purchase orders can be sent independently to a supplier in order that the dispensing cabinet is refilled.

The method according to the invention is characterized in that on the basis of the input data a control means controls a drive means for the storage unit, wherein a storage space containing the selected object is moved to the dispensing opening and one of several access doors is unlocked at the dispensing opening in front of the storage space containing the selected object in order to give access to the user. With the method the previously described advantages can be achieved.

The dispensing cabinet according to the invention and the method according to the invention are especially suitable for a controlled dispensing of tools in production plants. The tools can be e.g. drills, cutters etc. for which, up to now, extensive warehouses requiring a large workforce had to be maintained in some cases. However, the use of the dispensing cabinet according to the invention and the method according to the invention is not limited to such tools. In fact, other objects, piece goods and small parts can also be stored and dispensed. For example the use with office materials, medication or other types of medical products is possible, such as required in hospitals as a frequent consumable.

As a result of the invention the usage of such objects can be controlled very well and allocated reliably to the individual cost centers depending on the queried data. In addition, a reliable inventory management and an early procurement of replenishment supplies are ensured.

In the following the invention is described further by way of a preferred embodiment illustrated schematically in the accompanying drawings, wherein show:

DETAILED DESCRIPTION OF THE INVENTION

Figure 1:
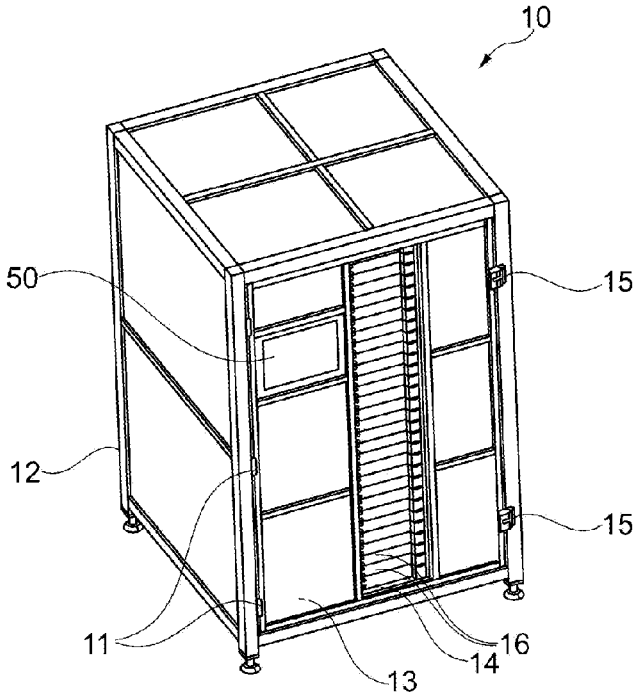
FIG. 1 a perspective view of a dispensing cabinet according to the invention.
Figure 2:
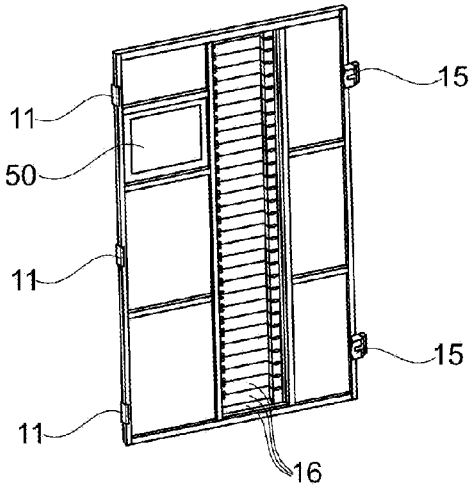
FIG. 2 a detailed view of a front door of the dispensing cabinet of FIG. 1.

According to FIGS. 1 and 2 a dispensing cabinet 10 pursuant to the invention comprises a box-shaped housing 12 which is constructed of support profiles, wherein the lateral surfaces are closed by wall panels. On a front side of the housing 12 a front door 13 is articulated via hinges 11. In particular, the front door 13 permits access to the interior of the housing 12 for maintenance purposes. The front door 13 is locked by means of locks 15 on the housing 12.

Figure 3:
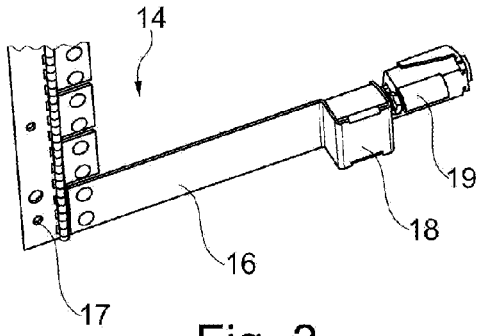
FIG. 3 an enlarged cut-out detailed view of an access door.

Along a center area of the front door 13 a vertically extending dispensing opening 14 is provided which is locked by a plurality of access doors 16. The construction and function of the access doors 16 becomes apparent from the enlarged illustration of FIG. 3.

The narrow, plate-shaped access door 16 is pivotably supported via a pivot joint 17 on the front door 13 and therefore on the housing 12. At the end of the access door 16 facing away from the pivot joint 17 a locking section 18 is designed which interacts with a locking unit 19 in order to lock the access door 16. The locking unit 19 is firmly mounted on the housing 12 or rather the front door 13. The locking unit 19 comprises an electromagnetic positioning element, with which the access door 16 can be unlocked electrically. When being unlocked, the access door 16 swings open towards the front about the pivot joint 17. In this way, a user is granted access to the area of the housing 12 lying behind the access door 16.

Figure 4:
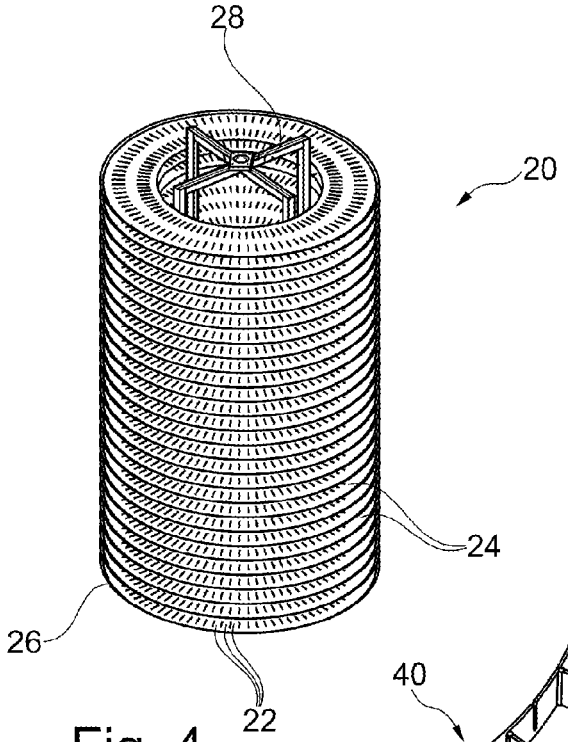
FIG. 4 a perspective view of a storage unit.
Figure 5:
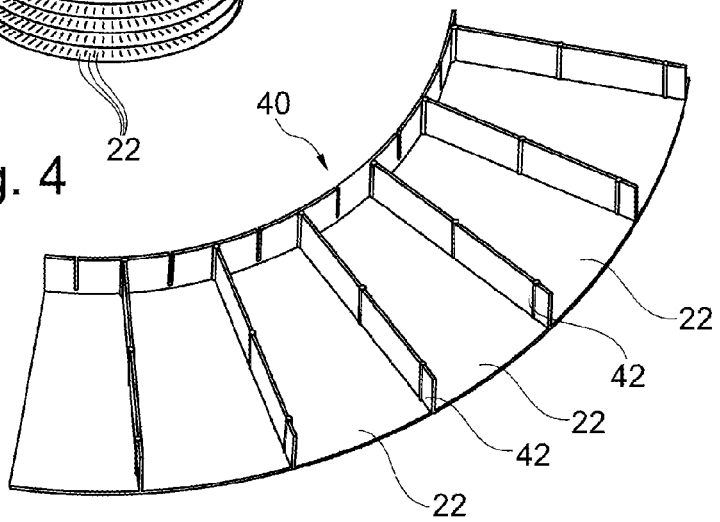
FIG. 5 an enlarged view of a storage module for the storage unit of FIG. 4.

Inside the housing 12 a storage unit 20 designed as a vertical carousel is supported in a rotatable manner, which is depicted schematically in FIG. 4. The storage unit 20 comprises a base plate 26 at the bottom, on which a support structure 28 consisting of vertical support columns is constructed. At their upper side the vertical support columns are reinforced with respect to each other by a connecting cross. Along the vertical support structure 28 circular disk-shaped storage levels 24 are arranged. The storage levels 24 each have a plurality of radially directed storage spaces 22 for receiving the objects to be stored. On the storage levels 24 storage modules 40 according to FIG. 5 can be arranged in particular. According to the example of FIG. 5 the storage modules are designed in an approximately quadrant-shaped manner as plastic parts. The storage modules 40 have a predetermined number of storage spaces 22 which are separated from each other by partition walls 42 and are open in the radial outward direction. The distance of the partition walls 42 from each other corresponds to the width of the dispensing opening 14 in front of the respective access doors 16. The size of the storage spaces 22 and in particular the distance of the partition walls 42 from each other can be different on the respective storage levels 24. The width of the dispensing opening 14 is adjustable for each storage level 24 by way of positioning sheet plates, not shown, that are located on the front door 13 as part of the housing 12.

Depending on the data input of the user on the input means 50, which is designed as a touch panel and embedded in the front door 13 in the illustrated embodiment, the carousel-like storage unit 20 is driven in a rotating manner via a drive means 30 by a control unit arranged behind the touch panel.

Figure 6:
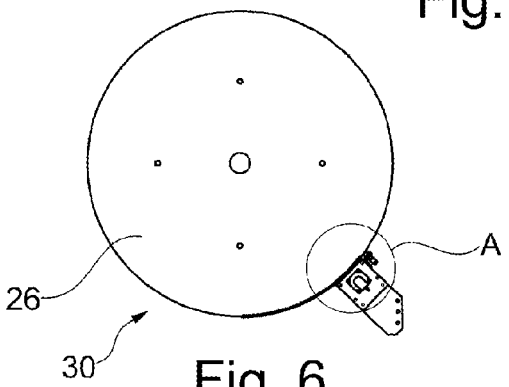
FIG. 6 a top view of a drive means for a storage unit.
Figure 7:
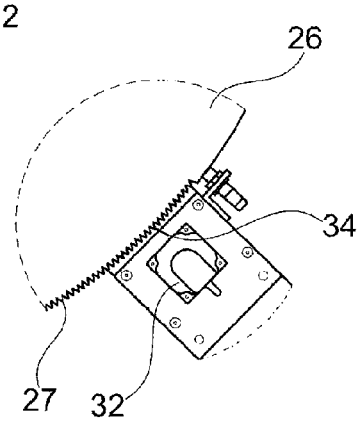
FIG. 7 an enlarged partly sectional detailed view of FIG. 6.

The drive means 30 is shown schematically in FIGS. 6 and 7. In the illustrated embodiment the base plate 26 of the carousel-like storage unit 20 has a cut-in external toothing 27 which meshes with a drive pinion 34 of an electric motor 32. The motor 32 is firmly connected to the housing 12.

According to the control unit and depending on the object selected by the user the storage unit 20 is rotated until the storage space 22 containing the selected object is located directly in front of the dispensing opening 14. Through the control unit the access door 16 is then unlocked on the storage level 24, on which the storage space 22 containing the selected object is arranged. The user can now remove the selected object from the storage space 22 and afterwards close the access door again. If the correct closure of the access door 16 has been ascertained via a sensor element by the control unit, a new dispensing process can take place.

The invention claimed is:

1. Dispensing cabinet for a controlled dispensing of objects, in particular tools, to authorized users, having a housing, a storage unit which is arranged in the housing and has a plurality of storage spaces for the objects, an input means for selecting an object to be dispensed and for inputting data relating to the object or user, and control unit, through which an authorization of the user can be verified on the basis of the data, wherein on the housing a dispensing opening is provided, at which several lockable access doors are arranged, drive means is arranged for moving the storage unit inside the housing, wherein a storage space containing the selected object can be positioned at the dispensing opening, and through the control unit the drive means can be controlled in order to position the selected object in front of the dispensing opening and the access door in front of the storage space containing the desired object can be unlocked in order to give access to a user, wherein through the control unit a usage of the objects can be controlled and in the case of a shortfall of a storage minimum number a reordering of objects can be carried out, wherein the storage unit is designed as a carousel which is supported and driven in a rotatable manner about a vertical axis of rotation, the carousel has several storage levels which are arranged on top of each other and each have a plurality of separated storage spaces, at the dispensing opening several access doors are arranged on top of each other, wherein one access door is in each case assigned to one storage level of the carousel, the access door is supported in a pivotable and spring-loaded manner, wherein the access door swings open on being unlocked, a size of the dispensing opening is adjustable for each storage level by way of positioning sheet plates, the housing has a box-shaped design consisting of support profiles, wherein the lateral surfaces are closed by wall plates, for access to the interior of the housing a front door is arranged on a front side of the housing between the support profiles, said front door being articulated by hinges and lockable by locks, on the front door, the input means are provided and in a center area of the front door, the access doors are provided in such a manner that the access doors constitute an external central plane of the front door, the carousel is formed with a disc-shaped base plate on which a support structure with support columns is arranged, the base plate has an outer circumference, the support columns are provided within the outer circumference of the base plate and are spaced from the vertical axis of rotation in a top view, the support columns are reinforced with respect to each other by a connecting cross, the storage levels are formed in a disc-shaped manner, each of the storage levels has an inner surface forming an inner circumference, and the disc-shaped storage levels are arranged on the supporting columns via their respective inner circumferences.

2. Dispensing cabinet according to claim 1, wherein the storage levels are of modular design.

3. Dispensing cabinet according to claim 1,
wherein
on the base plate a toothing is arranged, through which the carousel is driven by a motor.

4. Dispensing cabinet according to claim 1,
wherein
the control unit has a data memory as well as a computer.

5. Dispensing cabinet according to claim 1,
wherein
a remote data transmission means is provided.

6. Method for the controlled dispensing of objects to authorized users with a dispensing cabinet according to claim 1, in which
the objects are stored in storage spaces of a storage unit which is supported in a housing with a dispensing opening,
by means of an input means an object is selected by a user and object- and/or user-related data are input,
wherein on the basis of the input data a control unit verifies an authorization of the user and controls a drive means for the storage unit, wherein a storage space containing the selected object is moved to the dispensing opening and one of several access doors is unlocked at the dispensing opening in front of the storage space containing the selected object in order to give access to the user, and
the control unit controls a usage of the objects and in the case of a shortfall of a storage minimum number a reordering of objects is effected.

* * * * *